US011674689B2

(12) United States Patent
Ryon et al.

(10) Patent No.: US 11,674,689 B2
(45) **Date of Patent: *Jun. 13, 2023**

(54) COMBUSTOR WITH AN AIR MIXER AND AN AIR SWIRLER EACH HAVING SLOTS

(71) Applicant: Collins Engine Nozzles, Inc., Des Moines, IA (US)

(72) Inventors: Jason A. Ryon, Carlisle, IA (US); Lev A. Prociw, Johnston, IA (US); Jacob Greenfield, Granger, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/458,240

(22) Filed: Aug. 26, 2021

(65) Prior Publication Data

US 2021/0404661 A1 Dec. 30, 2021

Related U.S. Application Data

(63) Continuation of application No. 15/716,295, filed on Sep. 26, 2017, now Pat. No. 11,131,459.

(51) Int. Cl.

| | |
|---|---|
| ***F23R 3/28*** | (2006.01) |
| ***F23R 3/14*** | (2006.01) |
| ***F23R 3/34*** | (2006.01) |
| ***F23R 3/12*** | (2006.01) |

(52) U.S. Cl.

CPC ..... *F23R 3/286* (2013.01); *F23R 3/12* (2013.01); *F23R 3/14* (2013.01); *F23R 3/343* (2013.01)

(58) Field of Classification Search

CPC ..... F23R 3/12; F23R 3/14; F23R 3/286

See application file for complete search history.

(56) References Cited

U.S. PATENT DOCUMENTS

| | | | | |
|---|---|---|---|---|
| 4,271,675 | A | 6/1981 | Jones et al. | |
| 4,301,657 | A * | 11/1981 | Penny | F23R 3/12 60/750 |
| 4,903,478 | A | 2/1990 | Seto et al. | |
| 7,565,803 | B2 | 7/2009 | Li et al. | |
| 8,161,751 | B2 | 4/2012 | Hall | |
| 10,344,981 | B2 * | 7/2019 | Prociw | F23R 3/14 |
| 2014/0245742 | A1 | 9/2014 | Chew et al. | |

(Continued)

FOREIGN PATENT DOCUMENTS

| | | |
|---|---|---|
| EP | 1605204 A2 | 12/2005 |
| EP | 1605204 A3 | 3/2014 |

(Continued)

OTHER PUBLICATIONS

Extended European Search Report dated Dec. 3, 2018, issued during the prosecution of European Patent Applicatin No. EP 18196473.5.

(Continued)

*Primary Examiner* — William H Rodriguez

(57) ABSTRACT

An air mixer includes an annular body defining a center axis. A plurality of slots are defined in the annular body circumferentially spaced apart from one another. Each slot defines a respective center injection axis extending from an outer surface of the annular body to an inner surface of the annular body. Each respective center injection axis is parallel to a respective plane bisecting the annular body. At least one of the slots is intersected by the respective bisecting plane parallel to its respective center injection axis.

15 Claims, 6 Drawing Sheets

(56) References Cited

U.S. PATENT DOCUMENTS

| | | | | |
|---|---|---|---|---|
| 2014/0338337 | A1* | 11/2014 | Prociw | F23R 3/10<br>60/737 |
| 2017/0102147 | A1 | 4/2017 | Wang et al. | |
| 2018/0304281 | A1* | 10/2018 | Wirtz | F23R 3/12 |
| 2019/0186364 | A1* | 6/2019 | Greenfield | F23R 3/34 |

FOREIGN PATENT DOCUMENTS

| | | | |
|---|---|---|---|
| EP | 3048372 | A1 | 7/2016 |
| EP | 3309458 | A1 | 4/2018 |

OTHER PUBLICATIONS

European office action in corresponding EP application No. 18196473.5, dated Oct. 15, 2020.

* cited by examiner

COMBUSTOR WITH AN AIR MIXER AND AN AIR SWIRLER EACH HAVING SLOTS

CROSS-REFERENCE TO RELATED APPLICATION

This application is a divisional application of U.S. patent application Ser. No. 15/716,295 filed on Sep. 26, 2017, which is incorporated herein by reference in its entirety.

BACKGROUND OF THE INVENTION

1. Field of the Invention

The present disclosure relates to combustors, and more particularly to air mixers such as those used in combustor nozzles for gas turbine engines.

2. Description of Related Art

In gas turbine engines, such as industrial gas turbine engines used for power production, injectors within the gas turbine engine mix air and fuel together for combustion. To reduce NOx emissions, air and fuel need to be adequately mixed. If the injector does not mix the fuel and air well, less than desirable emissions can result. Typically, fuel is atomized with air fed through air injectors proximate to the fuel injector lip.

The conventional techniques have been considered satisfactory for their intended purpose. However, there is an ever present need for improved fuel injection and air-fuel mixing. This disclosure provides a solution for this.

SUMMARY OF THE INVENTION

An air mixer includes an annular body defining a center axis. A plurality of slots are defined in the annular body circumferentially spaced apart from one another. Each slot defines a respective center injection axis extending from an outer surface of the annular body to an inner surface of the annular body. Each respective center injection axis is parallel to a respective plane bisecting the annular body. At least one of the slots is intersected by the respective bisecting plane parallel to its respective center injection axis.

The respective plane bisecting the annular body can be parallel to two of the slot center axes. In accordance with some embodiments, the respective center injection axis for at least one of the plurality of slots is defined within its respective bisecting plane. Each slot can define a respective longitudinal axis defined between points on the inner surface of the annular body between opposing slot ends. At least one of the longitudinal axes can be angled with respect to the center axis of the annular body. At least one of the longitudinal axes can be angled with respect to the center axis of the annular body. At least one of the center injection axes can be perpendicular to the center axis of the annular body. At least one of the center injection axes can be at an oblique angle relative to the center axis of the annular body. A distance between an upstream side of a given one of the plurality of slots and its respective plane in a direction perpendicular to the respective plane can be different from a distance between a downstream side of the given slot and the respective plane in a direction perpendicular to the respective plane.

In accordance with another aspect, a combustor system includes a combustor case and a manifold operatively connected to the combustor case. A fuel distributor is downstream from and fluidly connected to the manifold. An air swirler is upstream from the fuel distributor to impart swirl to air going from within the combustor case into a combustor. An air mixer is downstream from the fuel distributor. The air mixer is similar to the air mixer described above.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
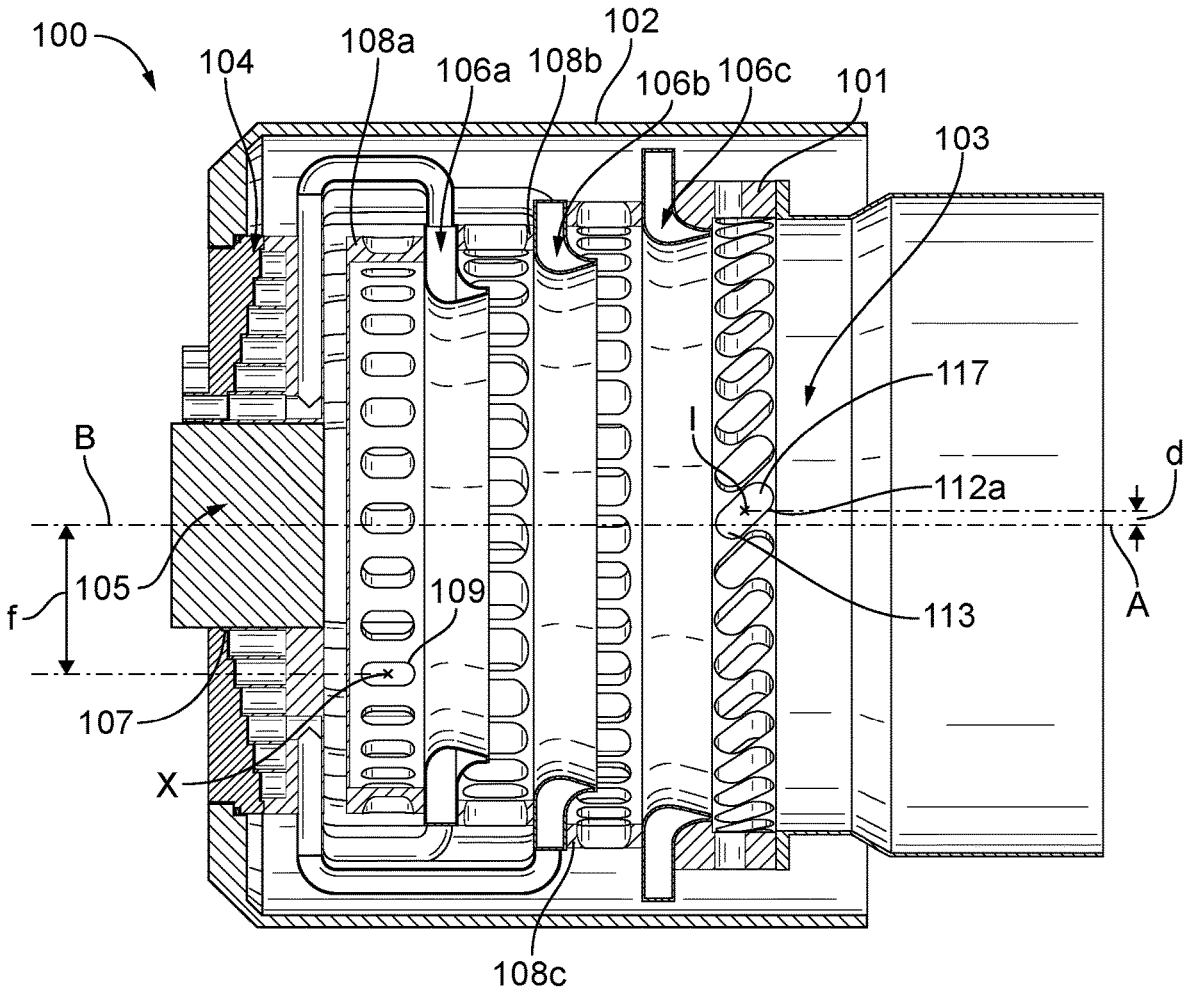
FIG. 1 is a schematic cross-sectional side view of an exemplary embodiment of a combustor system having an embodiment of an air mixer constructed in accordance with the present disclosure, showing circumferentially spaced apart injection slots.

Reference will now be made to the drawings wherein like reference numerals identify similar structural features or aspects of the subject disclosure. For purposes of explanation and illustration, and not limitation, a partial view of an exemplary embodiment of a combustor system with an exemplary embodiment of an air mixer in accordance with the disclosure is shown in FIG. 1 and is designated generally by reference character 100. Other embodiments of combustor systems in accordance with the disclosure, or aspects thereof, are provided in FIGS. 2A-4, as will be described. The systems and methods described herein can be used to distribute air and mix it with fluids, including gas or liquid fuel, such as in multiple stage, dual fuel injection for gas turbine engines.

As shown in FIG. 1, a combustor system 100 includes a combustor case 102 and a manifold 104 operatively connected to the combustor case. Stages of fuel distributors 106*a-c* are downstream from and fluidly connected to the manifold 104. The system 100 includes an ignitor 105 seated in a central passage 107 of the manifold 104 for ignition of fuel issued from the fuel distributors 106*a-c*. Air swirlers 108*a*, 108*b* and 108*c* are positioned alternating between fuel distributors 106*a-c* to impart swirl to air going from within the combustor case 102 into a combustor 103. The swirling air helps to atomize the fuel entering into combustor 103 from fuel distributors 106*a-c* and mixes with the fuel to create a fuel-air mixture. An air mixer 101 downstream from the downstream most fuel distributor 106*c* further mixes the fuel-air mixture.

Figure 2A:
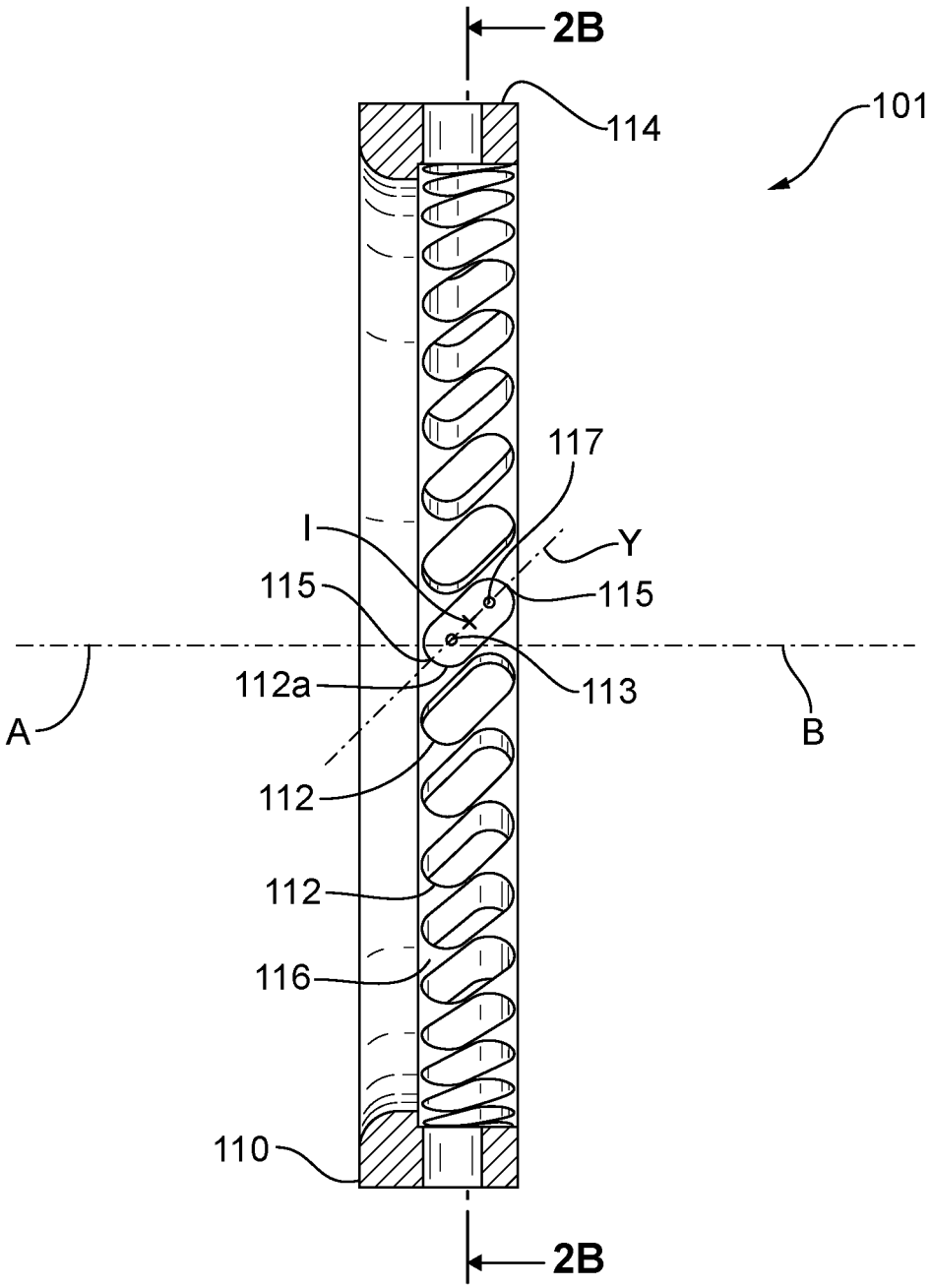
FIG. 2A is a schematic cross-sectional side view of the air mixer of FIG. 1, showing one of the injection slots with its respective injection axis.

With reference now to FIG. 2A, the air mixer 101 includes an annular body 110 defining a center axis A. A plurality of slots 112 are defined in the annular body 110 circumferentially spaced apart from one another. Each slot 112 defines a respective center injection axis I extending from an outer surface 114 of the annular body 110 to an inner surface 116 of the annular body 110. Each respective center injection axis I is parallel to a respective plane B that bisects the annular body 110. Respective plane B, shown in FIG. 2A, is associated with slot 112*a* and its respective injection axis I and is extending in and out of the plane of the paper in the orientation shown in FIGS. 1-2A. The respective center injection axis I for slot 112*a* is parallel to, but off-set from, respective plane B, e.g. the respective injection axis I for slot 112*a* is also extending in and out of the plane of the paper in the orientation shown in FIGS. 1-2A. Each slot 112 defines a respective longitudinal axis Y defined between points 115 on the inner diameter 116 of the annular body 110 between opposing slot ends. The slots 112 are tilted circumferentially so the longitudinal axes Y are angled with respect to the center axis A of the annular body 110.

Figure 2B:
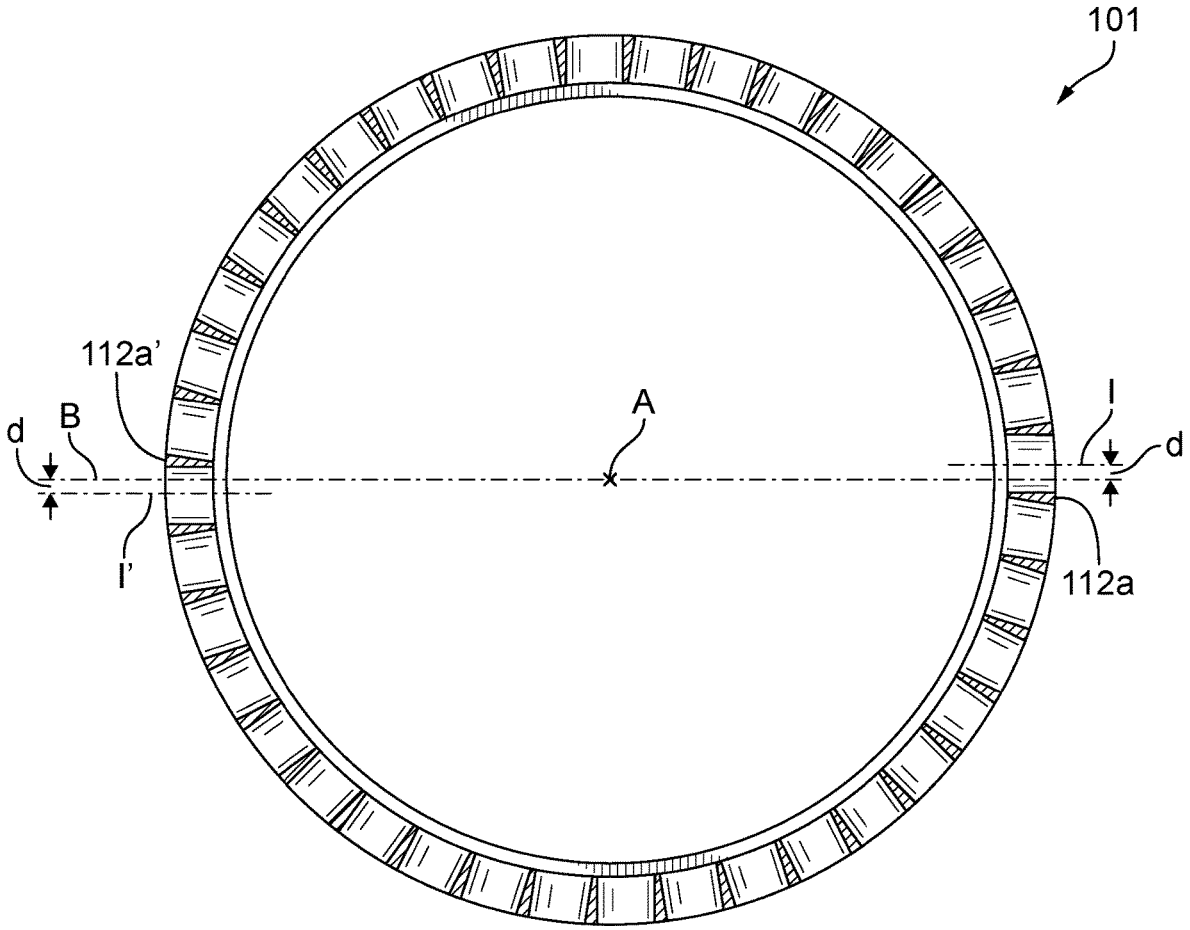
FIG. 2B is a schematic cross-sectional axial view of the air mixer of FIG. 1, showing the respective injection axis off-set from and parallel to its respective bisecting plane.

As shown in FIG. 2B, an axial facing view of annular body 110 along center axis A is shown. In this view, the respective plane B bisecting the annular body 110 is shown to be parallel to two of the slot center axes, labeled I and I' for clarity. The bisecting plane B intersects both of the slots 112*a* and 112*a*' associated with injection axes I and I'. The respective center injection axes I for each of the slots 112 is perpendicular to the center axis A for the annular body 110.

With reference now to FIGS. 1-2B, unlike air swirlers 108*a-c*, the slots 112 of air mixer 101 have little to no off-set, e.g. little to no tangential component to their injection direction. This is visible in FIG. 1 by comparing the distance d between injection axis I, associated with a respective slot 112*a*, and its respective parallel bisecting plane B, to the distance f between injection axis X, associated with a respective slot 109 of air swirler 108*a*, and its respective parallel bisecting plane B (the same as bisecting plane B parallel to injection axis I of slot 112*a*). Even with the slight off-set for air mixer 101, an upstream side 113 of the slot 112*a* will have less off-set than a downstream side 117 of the slot 112*a*. It is this differential off-set across a given slot 112 that creates intra-mixing within the air stream for that slot. This tends to be important for mixing with any fuel which is injected into the air stream from fuel distributor 106*c*. Having a slight off-set causes intra-circuit churning which allows the innermost air from the air mixer 101, e.g. the air entering from the upstream side 113 of the slots 112, to mix with the outermost air of the air mixer 101, e.g. the air entering from the downstream sides 117 of the slots 112. The off-set direction can be opposite of the off-set direction of the inner air swirler 108*b*, resulting in a slight counter-swirl between the two air circuits, or it can be in the same direction as the swirl from inner air swirler 108*b*, resulting in slight co-swirling. For ease of explanation, upstream and downstream sides 113 and 117, respectively, are designated by the respective centers for the arcs forming the ends of the pill shaped slots 112 defined on the inner surface 116 of air mixer 101.

Figure 3A:
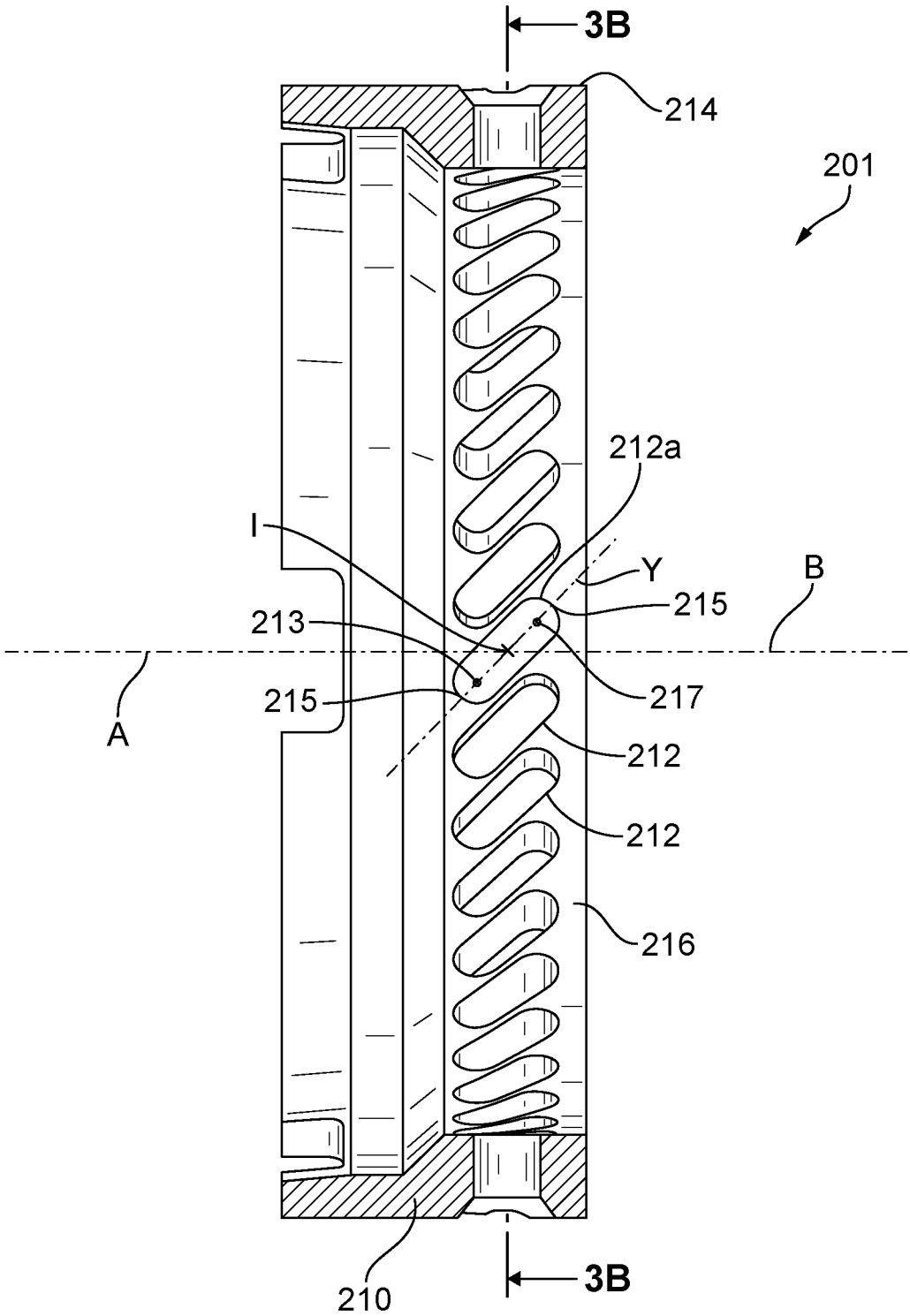
FIG. 3A is a schematic cross-sectional side view another embodiment of an air mixer constructed in accordance with the present disclosure, showing one of the injection slots with its respective injection axis.
Figure 3B:
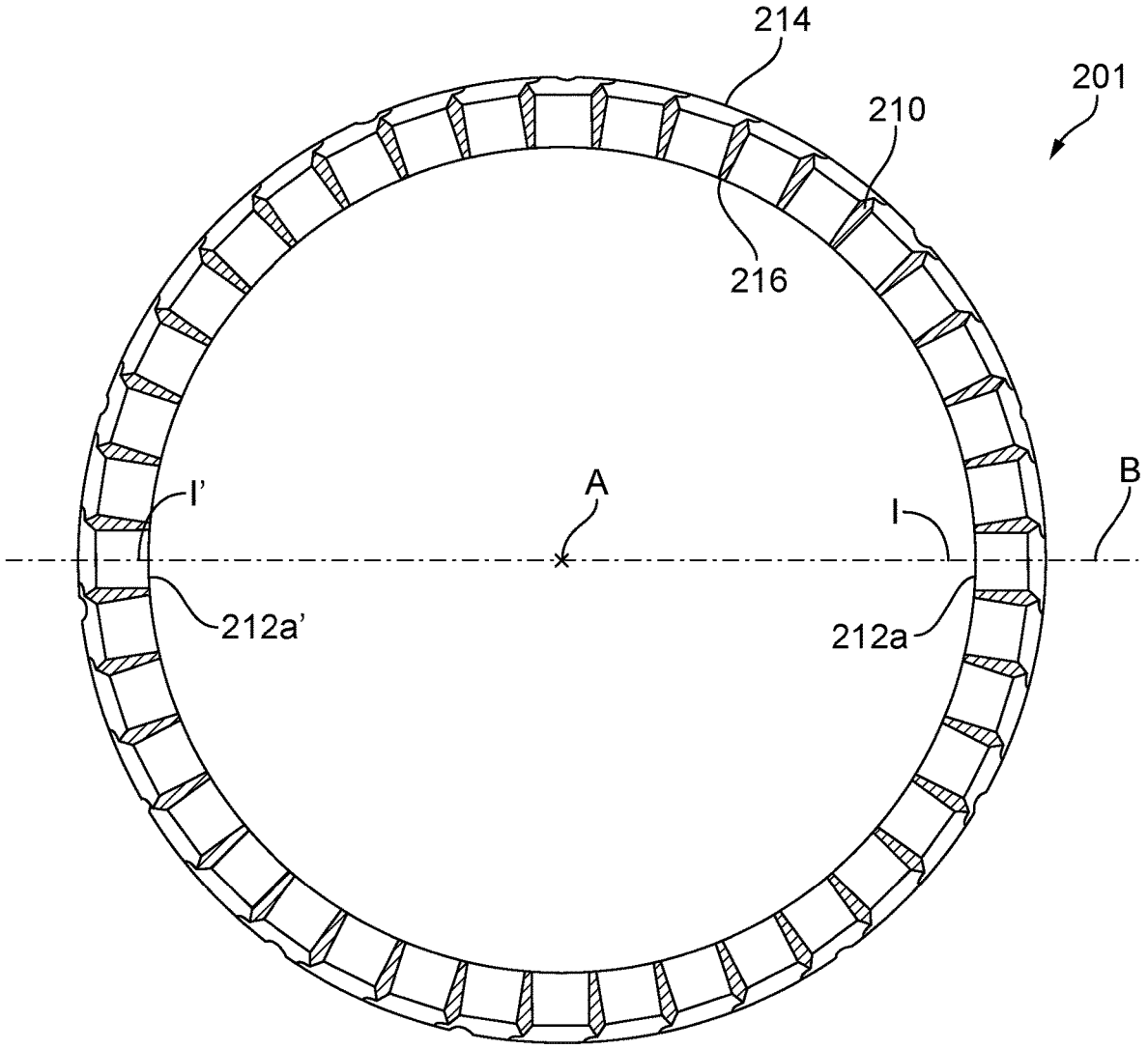
FIG. 3B is a schematic cross-sectional axial view of the air mixer of FIG. 3A, showing the respective injection axis off-set from and parallel to its respective bisecting plane.

In the embodiment of FIG. 3A-3B, an air mixer 201 includes an annular body 210 defining a center axis A. A plurality of slots 212 are defined in the annular body 210 circumferentially spaced apart from one another. Each slot 212 defines a respective center injection axis I extending from an outer surface 214 of the annular body 210 to an inner surface 216 of the annular body 210. Each respective center injection axis I is parallel to a respective plane B bisecting the annular body 210. Air mixer 201 is similar to air mixer 101 except that center injection axis I for a slot 212*a* is also defined within its respective bisecting plane B and intersects center axis A. For the respective plane B shown in FIGS. 3A-3B, which would be extending in and out of the plane of the paper as oriented in the views of FIGS. 3A-3B, the center injection axis I for slot 212*a* is parallel to respective plane B, e.g. the respective injection axis I for slot 212*a* is also extending in and out of the plane of the paper, as oriented in the view of FIG. 3A. The respective center injection axes I for each of the slots 212 is perpendicular to the center axis A for the annular body 210. Each slot 212 defines a respective longitudinal axis Y defined between points 215 on the inner surface of the annular body between opposing slot ends. The slots 212 are tilted circumferentially so the longitudinal axes Y are angled with respect to the center axis A of the annular body 210, similar to slots 112 described above. Those skilled in the art will readily appreciate that air mixer 201 can also be used in combustor system 100.

With continued reference to FIGS. 3A and 3B, slots 212 of air mixer 201 similarly have little to no off-set, e.g. little to no tangential component to their injection direction. A given one of slots 212 in the air mixer 201 also has a differential off-set across the slot. An upstream side 213 of the slot 212*a* will have an equal but opposite off-set to a downstream side 217 of the slot 212*a*. This differential off-set across a given slot 212 creates intra-mixing within the air stream similar to that described for slot 112. Having a slight off-set causes intra-circuit churning which allows the innermost air from the air mixer 201, e.g. the air entering from the upstream side 213 of the slots 212, to mix with the outermost air of the air mixer 201, e.g. the air entering from the downstream sides 217 of the slots 112.

Figure 4:
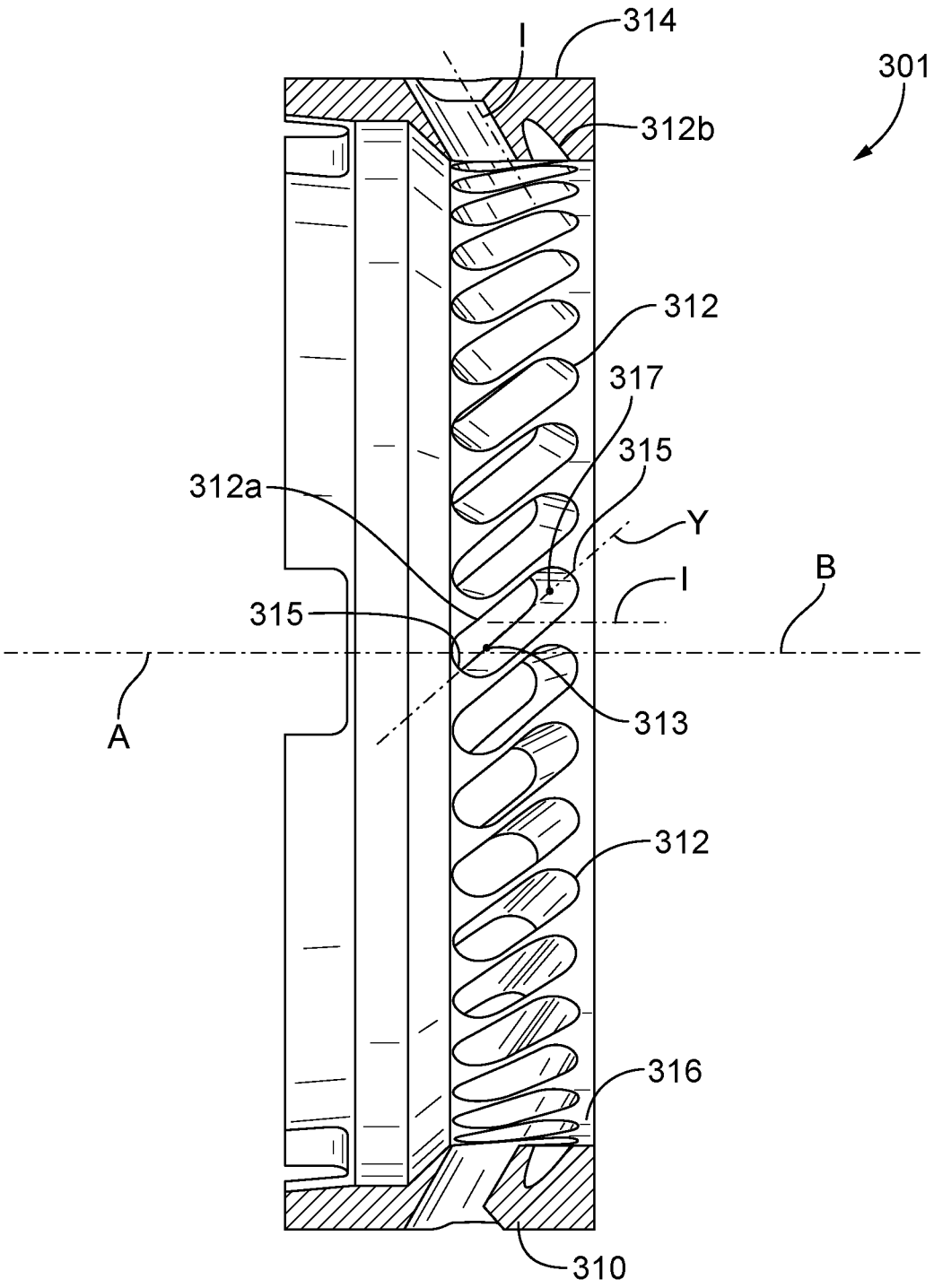
FIG. 4 is a schematic cross-sectional side view another embodiment of an air mixer constructed in accordance with the present disclosure, wherein one of the injection slots and its respective injection axis are shown, where the injection axis is off-set from and parallel to its respective bisecting plane.

In the embodiment of FIG. 4, an air mixer 301 includes an annular body 310 defining a center axis A. A plurality of slots 312 are defined in the annular body 310 circumferentially spaced apart from one another. Each slot 312 defines a respective center injection axis I extending from an outer surface 314 of the annular body 310 to an inner surface 316 of the annular body 310. Contrary to the embodiments of FIGS. 1-3B, described above, the respective center injection axes I for each of the slots 312 are at oblique angles relative to the center axis A of the annular body 310, meaning that a given center injection axis I for a respective slot 312 has a respective axial and radial component. This is evident by the injection axis I shown for the slot 312 depicted on the top side of the air mixer 301 as oriented in FIG. 4. Otherwise, the embodiment of FIG. 4 is substantially similar to those of FIGS. 1-3B. Each respective center injection axis I is parallel to a respective plane B bisecting the annular body 310. For the respective plane B associated with slot 312*a*, the center injection axis I for slot 312*a* is parallel to respective plane B, e.g. the respective injection axis I for slot 312*a* and bisecting plane B are extending in and out of the plane of the paper as oriented in FIG. 4. This can be seen with axis I for slot 312*b* at the top of FIG. 4. Those skilled in the art will readily appreciate that air mixer 301 can also be used in combustor system 100.

With continued reference to FIG. 4, slots 312 of air mixer 301 similarly have little to no off-set, e.g. little to no tangential component to their injection direction. A given one of slots 312 in air mixer 301 also has a differential off-set across the slot. An upstream side 313 of the slot 212*a* will have less off-set than a downstream side 317 of the slot 312*a*, similar to that described with respect to air mixer 101. This differential off-set across a given slot 312 creates intra-mixing within the air stream similar to that described for slot 112. Having a slight off-set causes intra-circuit churning which allows the innermost air from the air mixer 301, e.g. the air entering from the upstream side 313 of the slots 312, to mix with the outermost air of the air mixer 301, e.g. the air entering from the downstream sides 317 of the slots 312.

It is contemplated that air mixers 101, 201 and 301 as described herein can be retrofitted into existing combustors and gas turbine engines. The methods and systems of the present disclosure, as described above and shown in the drawings, provide for combustor systems with superior properties including better fuel-air mixing, resulting in more efficient burning and reduced emissions. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. An air mixer comprising:

an annular body defining a center axis; and a plurality of slots defined in the annular body circumferentially spaced apart from one another, wherein each slot defines a respective center injection axis extending from an outer surface of the annular body to an inner surface of the annular body, wherein each respective center injection axis is parallel to a respective plane bisecting the annular body, wherein at least one of the slots is intersected by the respective bisecting plane parallel to its respective center injection axis, wherein at least one of the center injection axes is at an oblique angle relative to the center axis of the annular body.

2. The air mixer as recited in claim 1, wherein the respective plane bisecting the annular body is parallel to two of the slot center injection axes.

3. The air mixer as recited in claim 1, wherein the respective center injection axis for at least one of the plurality of slots is defined within its respective bisecting plane.

4. The air mixer as recited in claim 1, wherein each slot defines a respective longitudinal axis defined between points on the inner surface of the annular body between opposing slot ends.

5. The air mixer as recited in claim 1, wherein each slot defines a respective longitudinal axis defined between points on the inner surface of the annular body between opposing slot ends, wherein at least one of the longitudinal axes is angled with respect to the center axis of the annular body.

6. The air mixer as recited in claim 1, wherein at least one of the center injection axes is perpendicular to the center axis of the annular body.

7. The air mixer as recited in claim 1, wherein a distance between an upstream side of a given one of the plurality of slots and its respective plane in a direction perpendicular to the respective plane is different from a distance between a downstream side of the given slot and the respective plane in a direction perpendicular to the respective plane.

8. A combustor system comprising:

a combustor case;

a manifold operatively connected to the combustor case;

a fuel distributor downstream from and fluidly connected to the manifold;

at least one air swirler upstream from the fuel distributor to impart swirl to air going from within the combustor case into a combustor; and an air mixer downstream from the fuel distributor and axially downstream from the at least one air swirler, wherein the air mixer includes:

an annular body defining a center axis; and a plurality of slots defined in the annular body circumferentially spaced apart from one another, wherein each slot defines a respective center injection axis extending from an outer surface of the annular body to an inner surface of the annular body, wherein each respective center injection axis is parallel to the respective plane bisecting the annular body, wherein at least one of the slots is intersected by the respective bisecting plane parallel to its respective center injection axis, wherein a first offset defines a distance between the respective bisecting plane of the annular body and the respective center injection axis of the slot of the air mixer, wherein the first offset is the same magnitude as a second offset, the second offset defining a distance between the respective bisecting plane of the annular body and the respective center injection axis of the at least one air swirler, wherein at least one of the center injection axes is at an oblique angle relative to the center axis of the annular body.

9. The combustor system as recited in claim 8, wherein the respective plane bisecting the annular body is parallel to two of the slot center injection axes.

10. The combustor system as recited in claim 8, wherein the respective center injection axis for at least one of the plurality of slots is defined within its respective bisecting plane.

11. The combustor system as recited in claim 8, wherein each slot defines a respective longitudinal axis defined between points on the inner surface of the annular body between opposing slot ends.

12. The combustor system as recited in claim 8, wherein each slot defines a respective longitudinal axis defined between points on the inner surface of the annular body between opposing slot ends, wherein at least one of the longitudinal axes is angled with respect to the center axis of the annular body.

13. The combustor system as recited in claim 8, wherein at least one of the center injection axes is perpendicular to the center axis of the annular body.

14. The combustor system as recited in claim 8, wherein a distance between an upstream side of a given one of the plurality of slots and its respective plane in a direction perpendicular to the respective plane is different from a distance between a downstream side of the given slot and the respective plane in a direction perpendicular to the respective plane.

15. A combustor system comprising:

a combustor case;

a combustor within the combustor case;

a combustion chamber defined within the combustor;

a fuel manifold operatively connected to the combustor case;

an annular fuel distributor downstream from and fluidly, connected to the fuel manifold, wherein the annular fuel distributor is configured to provide fuel into the combustion chamber, wherein the annular fuel distributor defines a portion of the combustion chamber;

at least one air swirler upstream from the fuel distributor, wherein the at least one air swirler defines a portion of the combustion chamber, wherein the at least one air swirler is configured to impart swirl to air going from between the combustor case and the combustor into the combustion chamber, wherein the at least one air swirler includes:

a first annular body defining a first center axis; and a first plurality of slots defined in the first annular body, the first plurality of slots circumferentially spaced apart from one another, wherein each slot of the first plurality of slots defines a respective center injection axis parallel to a respective plane bisecting the first annular body; and an air mixer downstream from the annular fuel distributor and the at least one air swirler, wherein the air mixer defines a portion of the combustion chamber, wherein the air mixer is configured to impart swirl to air going from between the combustor case and the combustor into the combustion chamber, wherein the air mixer includes:

a second annular body defining a second center axis; and a second plurality of slots defined in the second annular body, the second plurality of slots circumferentially spaced apart from one another, wherein each slot of the second plurality of slots defines a respective center injection axis extending between an outer surface of the second annular body and an inner surface of the second annular body, wherein each respective center injection axis is parallel to a respective plane bisecting the second annular body, wherein at least one slot of the second plurality of slots is intersected by the respective plane bisecting the second annular body, wherein a first offset defines a distance between the respective plane corresponding with the at least one slot of the second plurality of slots and the respective center injection axis of the at least one slot of the second plurality of slots, wherein the first offset distance is measured perpendicular to the respective plane corresponding with the at least one slot of the second plurality of slots, wherein the first offset is equal in magnitude but opposite in direction than a second offset, wherein the second offset defines a distance between the respective plane corresponding with a first slot of the first plurality of slots and the respective center injection axis of the first slot of the first plurality of slots, wherein the second offset distance is measured perpendicular to the respective plane corresponding with the first slot of the first plurality of slots.

* * * * *